US011649536B2

(12) United States Patent
Muller et al.

(10) Patent No.: US 11,649,536 B2
(45) Date of Patent: May 16, 2023

(54) METHOD FOR MANUFACTURING A STRUCTURE COMPONENT FOR A MOTOR VEHICLE BODY

(71) Applicant: Constellium Neuf-Brisach, Biesheim (FR)

(72) Inventors: Estelle Muller, Grenoble (FR); Olivier Rebuffet, Grenoble (FR); Guillaume Delgrange, Lyons (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 670 days.

(21) Appl. No.: 16/500,724

(22) PCT Filed: Apr. 3, 2018

(86) PCT No.: PCT/FR2018/050829

§ 371 (c)(1),
(2) Date: Oct. 3, 2019

(87) PCT Pub. No.: WO2018/185425

PCT Pub. Date: Oct. 11, 2018

(65) Prior Publication Data

US 2020/0109466 A1 Apr. 9, 2020

(30) Foreign Application Priority Data

Apr. 6, 2017 (FR) ..... 1753018

(51) Int. Cl.
*C22F 1/05* (2006.01)
*C22C 21/02* (2006.01)
*C22C 21/08* (2006.01)

(52) U.S. Cl.
CPC ..... *C22F 1/05* (2013.01); *C22C 21/02* (2013.01); *C22C 21/08* (2013.01)

(58) Field of Classification Search
CPC ..... C22F 1/05; C22C 21/02; C22C 21/08
See application file for complete search history.

(56) References Cited

U.S. PATENT DOCUMENTS

2002/0039664 A1 4/2002 Magnusen et al.
2005/0028894 A1* 2/2005 Hoffmann ..... C22C 21/02 148/417

(Continued)

FOREIGN PATENT DOCUMENTS

EP 0679199 A1 11/1995
EP 1305179 B1 9/2005

(Continued)

OTHER PUBLICATIONS

Gaute Svenningsen et al., "Effect of low copper content and heat treatment on intergranular corrosion of model AlMgSi alloys", Corrosion Science, vol. 48, pp. 226-242 (2006).

(Continued)

*Primary Examiner* — Anthony J Zimmer
*Assistant Examiner* — Nazmun Nahar Shams
(74) *Attorney, Agent, or Firm* — McBee Moore & Vanik IP, LLC

(57) ABSTRACT

The invention relates to a method for producing a stamped component of motor vehicle bodywork or body structure from aluminium alloy comprising the steps of producing a metal sheet or strip of thickness between 1.0 and 3.5 mm in an alloy of composition (% by weight): Si: 0.60-0.85; Fe: 0.05-0.25; Cu: 0.05-0.30; Mn: 0.05-0.30; Mg: 0.50-1.00; Ti: 0.02-0.10; V: 0.00-0.10 with Ti+V≤0.10, other elements each <0.05, and <0.15 in total, remainder aluminium, with Mg<−2.67×Si+2.87, dissolving and steeping, pre-tempering, maturation for between 72 hours and 6 months, stamping, tempering at a temperature of around 205° C. with a hold time between 30 and 170 minutes or tempering at a time-temperature equivalent, painting and "bake hardening"

(Continued)

of the paints at a temperature of 150 to 190° C. for 15 to 30 minutes.

15 Claims, 2 Drawing Sheets

(56) References Cited

U.S. PATENT DOCUMENTS

| | | | | |
|---|---|---|---|---|
| 2007/0209739 | A1* | 9/2007 | Zhao | C22F 1/05 148/551 |
| 2014/0220381 | A1* | 8/2014 | Muller | C22F 1/05 428/654 |

FOREIGN PATENT DOCUMENTS

| | | | |
|---|---|---|---|
| EP | 1702995 | A1 | 9/2006 |
| EP | 1601478 | B1 | 10/2007 |
| EP | 2581218 | A1 | 4/2013 |
| JP | 2003-305503 | A | 10/2003 |
| WO | 9514113 | A1 | 5/1995 |
| WO | 2003/006697 | A1 | 1/2003 |
| WO | 2004/113579 | A1 | 12/2004 |

OTHER PUBLICATIONS

Hoogovens Research & Development, "Optimizing the strength and corrosion resistance balance of aluminium 6XXX series alloy for automotive body sheet applications", vol. 426, No. 6 (1999).

Rami Abi-Akl et al., "Paint-bake effect on the plasticity and fracture of pre-stained aluminum 6451 sheets", International Journal of Mechanical Sciences, vol. 124, p. 68-82 (2017).

Dominique Daniel et al., "Development of 6xxx Alloy Aluminum Sheet for Autobody Outer Panels: Bake Hardening, Formability and Trimming Performance", SAE Technical Paper 1999-01-3195, vol. 10, pp. 1-10 (1999).

PCT International Search Report for PCT/FR2018/050829, dated May 29, 2018.

* cited by examiner

METHOD FOR MANUFACTURING A STRUCTURE COMPONENT FOR A MOTOR VEHICLE BODY

CROSS-REFERENCE TO RELATED APPLICATIONS

This application is the National Stage entry of International Application No. PCT/FR2018/050829, filed 3 Apr. 2018, which claims priority to France Application No. 1753018, filed 6 Apr. 2017.

BACKGROUND

Field

Field of the Invention

The invention relates to the field of motor vehicle structure parts or components, also referred to as "body in white", manufactured in particular by stamping aluminium alloy sheets, more particularly alloys in the AA6xxx series in accordance with the designation of the Aluminium Association, intended to absorb energy irreversibly at the time of an impact, and having excellent compromise between high mechanical strength and good behaviour in a crash, such as in particular impact absorbers or "crashboxes", reinforcement parts, linings, or other bodywork structure parts.

More precisely, the invention relates to the manufacture of such components by stamping in a solution-hardened, quenched and naturally aged temper state followed by hardening by on-part ageing and a treatment of baking the paint or "bake hardening".

Description of Related Art

As a preamble, all aluminium alloys in question hereinafter are, unless indicated to the contrary, designated by the designations defined by the Aluminium Association in the Registration Record Series that it publishes regularly.

All the indications relating to the chemical composition of the alloys are expressed as a percentage by weight based on the total weight of the alloy.

The expression 1.4×Si means that the silicon content expressed as a percentage by weight is multiplied by 1.4.

The definitions of the metallurgical states are indicated in the European standard EN 515.

The static tensile mechanical characteristics, in other words the ultimate tensile strength $R_m$, the tensile yield strength at 0.2% elongation $Rp_{0.2}$, and the elongation at break A %, are determined by a tensile test in accordance with NF EN ISO 6892-1.

The bending angles, referred to as alpha norm, are determined by a three-point bending test in accordance with NF EN ISO 7438 and the procedures VDA 238-100 and VDA 239-200.

Aluminium alloys are increasingly used in automobile construction in order to reduce the weight of the vehicles and thus reduce fuel consumption and discharges of greenhouse gases.

Aluminium alloy sheets are used in particular for manufacturing many parts of the "body in white", among which there are bodywork skin parts (or external bodywork panels) such as the front wings, roofs, bonnet, boot or door skins, and the lining parts or bodywork structure components such as for example door, bonnet, tailgate or roof linings or reinforcements, or spars, bulkheads, load-bearing floors, tunnels and front, middle and rear pillars, and finally the impact absorbers or "crashboxes".

If numerous skin parts are already produced from aluminium alloy sheets, the transposition of steel to aluminium of lining or structure parts having complex geometries proves to be more tricky. Firstly, because of the less good formability of aluminium alloys compared with steels and secondly because of the mechanical properties that are in general inferior to those of steels used for this type of part.

This is because this type of application requires a set of properties, sometimes conflicting, such as:

- high formability in the delivery temper, temper T4, in particular for stamping operations,
- a controlled tensile yield strength at the delivery condition of the sheet in order to master the spring back when shaping,
- good behaviour in the various assembly methods used in automobile bodywork such as spot welding, laser welding, adhesive bonding, clinching or riveting,
- high mechanical strength after cataphoresis and baking of the paint in order to obtain good mechanical strength in service while minimising the weight of the part,
- good energy absorption capacity in the event of impact for application to bodywork structure parts,
- good resistance to corrosion, in particular intergranular corrosion, stress corrosion and filiform corrosion of the finished part,
- compatibility with the requirements for recycling of manufacturing waste or recycled vehicles,
- acceptable cost of mass production.

There do however now exist mass-produced motor vehicles having a body in white consisting mainly of aluminium alloys. For example, the Ford F-150 model 2014 version consists of AA6111 structure alloy. This alloy was developed by the Alcan group in the years 1980-1990. Two references describe this development work:

P. E. Fortin et al, "An optimized Al alloy for auto body sheet applications", SAE technical conference, March 1984, describes the following composition:

| [Fortin] | Si | Fe | Cu | Mn | Mg | Cr | Zn | Ti |
|---|---|---|---|---|---|---|---|---|
| AA6111 | 0.85 | 0.20 | 0.75 | 0.20 | 0.72 | — | — | — |

M. J. Bull et al, "Al sheet alloys for structural and skin applications", 25th ISATA symposium, Paper 920669, June 1992:

The main property remains high mechanical strength, even if it is initially designed to withstand indentation for applications of the skin type: "A yield-strength of 280 MPa is achieved after 2% pre-strain and 30 min at 177° C.".

Moreover, other alloys in the AA6xxx family with high mechanical characteristics have been developed for aeronautical or automobile applications. Thus the alloy of the type AA6056, the development of which dates from the 1980s at Pechiney, has been the subject of many works and numerous publications, either to optimise the mechanical properties or to improve the resistance to intergranular corrosion. We shall adopt the automobile application of this type of alloy, which was the subject of a patent application (WO 2004/113579 A1).

Alloys of the AA6013 type have also been the subject of numerous works. For example, at Alcoa, in the application US 2002/039664 published in 2002, an alloy comprising 0.6-1.15% Si; 0.6-1% Cu; 0.8-1.2% Mg; 0.55-0.86% Zn; less than 0.1% Mn; 0.2-0.3% Cr and approximately 0.2% Fe, used in the T6 temper, combines good resistance to intergranular corrosion and an $Rp_{0.2}$ of 380 MPa.

At Aleris, an application published in 2003, WO 03006697, relates to an alloy in the AA6xxx series with 0.2% to 0.45% Cu. The object of the invention is to propose an alloy of the AA6013 type with a reduced Cu level, targeting 355 MPa of Rm in the T6 temper and good resistance to intergranular corrosion. The composition claimed is as follows: 0.8-1.3% Si, 0.2-0.45% Cu; 0.5-1.1% Mn; 0.45-0.1% Mg.

Finally, it should be noted that, in the majority of the aforementioned examples, the obtaining of the high mechanical characteristics ($Rp_{0.2}$, Rm) is achieved by using alloys containing at least 0.5% copper.

Structural parts for an automobile application made from a 7xxx alloy as described for example in the application EP 2 581 218 are also known.

Furthermore, for producing parts with a complex geometry from aluminium alloy, such as for example a door lining, which cannot be achieved by conventional stamping with the aforementioned alloys, various solutions have been envisaged and/or implemented in the past:

- Getting round the difficulty relating to stamping by producing this type of part by moulding and in particular of the "under-pressure" type. The patent EP 1 305 179 B1 of Nothelfer GmbH under priority of 2000 testifies to this.
- Carrying out a so-called "tepid" stamping to benefit from better suitability for stamping. This consists of heating the aluminium alloy blank, totally or locally, to a so-called intermediate temperature, that is to say 150° to 350° C., in order to improve its behaviour under the press, the tool of which may also be preheated. The patent EP 1 601 478 B1 of the applicant, under priority of 2003, is based on this solution.
- Modifying, via its composition, the suitability for stamping of the alloy in the AA5xxx series itself; it has in particular been proposed to increase the magnesium content beyond 5%. But this is not neutral in terms of corrosion resistance.
- Using composite sheets consisting of an alloy core in the AA5xxx series, with an Mg content beyond 5% for better formability, and a clad sheet made from an alloy better resisting corrosion. However, the corrosion resistance at the edges of the sheet, in punched zones or more generally where the core is exposed, and particularly in assemblies, may then prove to be insufficient.
- Finally, carrying out asymmetric rolling in order to create a more favourable crystallographic texture has also been proposed. The application JP 2003-305503 of Mitsubishi Aluminium testifies to this. However, carrying out this type of asymmetric rolling on an industrial scale is tricky, requires specific rolling mills, may have an unfavourable impact on the surface appearance of the sheets obtained, and may also give rise to high additional costs.
- Moreover, the document EP 1702995 A1 describes a method for producing a sheet of aluminium alloy, which comprises the supply of a molten aluminium alloy having a chemical composition, as a percentage by weight, Mg: 0.30 to 1.00%, Si: 0.30 to 1.20%, Fe: 0.05 to 0.50%, Mn: 0.05 to 0.50%, Ti: 0.005 to 0.10%, optionally one or more from among Cu: 0.05 to 0.70% and Zr: 0.05 to 0.40%, and the remainder: Al and unavoidable impurities: the casting of the molten alloy in a plate having a thickness of 5 to 15 mm by the double-strip casting method with a cooling rate at ¼ of the thickness of the plate of 40° to 150° C./s, coiling in the form of a reel, homogenisation treatment, cooling of the resulting reel to a temperature of 250° C. at least at a cooling rate of 500° C./h or more, followed by cold rolling, and then solution heat treatment. This document does not mention on-part ageing after forming.

Having regard to the increasing development of the use of aluminium sheets for automobile bodywork components and mass production, there still exists a demand for further improved grades making it possible to reduce thicknesses without impairing the other properties so as always to increase lightening.

Obviously this change is achieved through the use of alloys with higher and higher elastic limits, and the solution consisting of using stronger and stronger alloys in the AA6xxx series, formed in the T4 temper, that is to say after a solutionized and quenched temper, and substantial hardening during operations of pre-ageing and baking of the paints and varnishes, reaches its limits. It results in alloys that are harder and harder from the T4 temper and which, because of this, pose serious problems of forming.

Problem Posed

The invention aims to obtain an excellent compromise between formability in the T4 temper and high mechanical strength as well as good behaviour of the finished component under riveting and in a crash, by proposing a method for manufacturing such components by forming in the T4 metallurgical temper after natural ageing at ambient temperature, followed by hardening by ageing on a formed part and baking of the paints or bake hardening. One problem is also to achieve a short and economically advantageous method.

These components must also have very good corrosion resistance and good behaviour in the various assembly processes such as spot welding, laser welding, adhesive bonding, clinching or riveting.

SUMMARY

The subject of the invention is a method for manufacturing a formed component, in particular stamped, for automobile bodywork or body structure, also referred to as "body in white", from aluminium alloy, comprising the following steps:

- manufacture of a sheet or strip with a thickness of between 1 and 3.5 mm from an alloy with the composition (% by weight):
  - Si: 0.60-0.85; Fe: 0.05-0.25; Cu: 0.05-0.30; Mn: 0.05-0.30; Mg: 0.50-1.00; Ti: 0.02-0.10; V: 0.00-0.10 with $Ti+V \leq 0.10$ other elements <0.05 each and <0.15 in total, the remainder aluminium, with $Mg < -2.67 \times Si + 2.87$,
- solution heat treatment, quenching and optional pre-ageing at a temperature generally between 50° and 100° C. for a period of at least 12 hours, and typically obtained by coiling at a temperature of at least 60° C. followed by cooling in free air,
- natural ageing at ambient temperature, typically for between 72 hours and 6 months,
- forming, in particular by press stamping, in order to obtain a three-dimensional part,
- on-part artificial ageing at a temperature of substantially 205° C. with a holding time between 30 and 170 minutes, and preferably between 60 and 120 minutes, or artificial ageing at an equivalent time-temperature, that is to say with an equivalent holding time $t_{eq}$ at the temperature $T_{eq}$ of 205° C. of between 30 and 170 minutes, and preferably between 60 and 120 minutes, in accordance with the equation:

$$\int_0^{t} \exp\left(\frac{-Q}{RT}\right)dt = \int_0^{teq} \exp\left(\frac{-Q}{RTeq}\right)dt$$

where Q is equal to sensibly 82915 J, in which T is the instantaneous temperature expressed in Kelvin that changes with the time t and $T_{eq}$ is the reference temperature of 205° C. (478 K), and teq is the equivalent time, painting and "bake hardening" at a temperature of 150° to 190° C. and preferably 170° to 190° C. for 15 to 30 minutes.

Three-dimensional part means a part for which there exists no direction in which the cross section of said part is constant along the whole of said direction.

Another subject of the invention is a stamped bodywork component or automobile body structure, also referred to as "body in white", produced by a method according to any of claims 1 to 10, characterised in that its tensile yield strength, determined in accordance with NF EN ISO 6892-1, is $Rp_{0.2} \leq 270$ MPa and preferably ≤275 MPa, and in that its "three-point bending angle" αnorm, determined in accordance with NF EN ISO 7438 and the procedures VDA 238-100 and VDA 239-200, is ≥≤100° and preferably ≥105° with $\alpha norm \geq -(4/3)*Rp_{0.2}+507$.

Finally, the invention also encompasses a stamped automobile bodywork or body structure component, also referred to as "body in white", according to the invention, such as in particular a door, bonnet, tailgate or roof lining or reinforcement, or the spars, bulkheads, load-bearing floors, tunnels and front, middle or rear pillars or uprights, as well as the impact absorbers or "crashboxes".

DETAILED DESCRIPTION OF A PREFERRED EMBODIMENT

Figure 1:
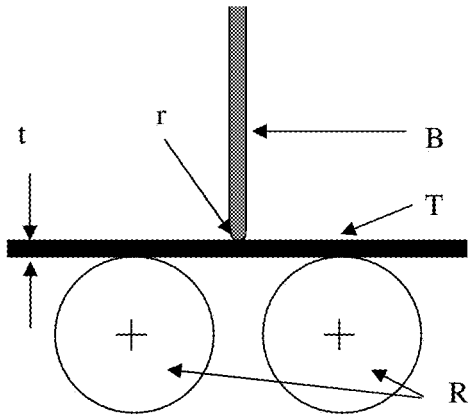
FIG. 1 depicts the device for "three-point bending test" consisting of two rollers R, and a punch B of radius r, for carrying out the bending of the sheet T of thickness t.

The invention is based on the finding made by the applicant that it is entirely possible, by means of a suitable composition and manufacturing method, to obtain sheets having excellent suitability for stamping after solution-hardened, quenching and naturally ageing temper at ambient temperature, and sufficient mechanical strength in the artificially aged temper and after paint baking treatment, typically and respectively for 4 hours and 20 minutes at 205° C. and 180° C., while guaranteeing suitability for riveting and crash resistance of the finished component that are very satisfactory. The mechanical properties achieved in the latter metallurgical temper are a tensile yield strength $Rp_{0.2} \geq 270$ MPa, and a bending angle αnorm without cracking ≥100° C. and preferably ≥105° C., with $\alpha norm \geq -(4/3)*Rp_{0.2}+507$.

The composition of the alloy according to the invention is as follows (% by weight): Si: 0.60-0.85; Fe: 0.05-0.25; Cu: 0.05-0.30; Mn: 0.05-0.30; Mg: 0.50-1.00; Ti: 0.02-0.10; V: 0.00-0.10, with Ti+V≤0.10, other elements <0.05 each and <0.15 in total, the remainder aluminium, with $Mg < -2.67 \times Si + 2.87$.

The concentration ranges imposed on the elements making up this type of alloy are explained thereby by the following reasons:

Si: silicon is, with magnesium, the first alloy element of aluminium-magnesium-silicon systems (AA6xxx family) to form the intermetallic compounds $Mg_2Si$ or $Mg_5Si_6$ which contribute to the structural hardening of these alloys. The presence of silicon, in a proportion of between 0.60% and 0.85%, combined with the presence of magnesium, in a proportion of between 0.50% and 1.00%, with $Mg < -2.67 \times Si + 2.87$, makes it possible to obtain the Si/Mg ratio required for achieving the mechanical properties sought while guaranteeing good corrosion resistance and satisfactory forming under stamping at ambient temperature. This is because, if $Mg > -2.67 \times Si + 2.87$ for the silicon and magnesium proportions according to the invention, the alloys cannot generally be solutionized, which thereby would be detrimental to the compromise sought.

The most advantageous content range for silicon is 0.60 to 0.75%.

Mg: Generally, the level of mechanical characteristics of alloys in the AA6xxx family increases with the magnesium content. Combined with silicon in order to form the intermetallic compounds $Mg_2Si$ or $Mg_5Si_6$, magnesium contributes to the increase in mechanical properties. A minimum content of 0.50% is necessary for obtaining the required level of mechanical properties and to form sufficient hardening precipitates. Beyond 1.00%, the Si/Mg ratio obtained is unfavourable to the sought property compromise.

The most advantageous content range for magnesium is 0.60 to 0.70%.

Fe: Iron is generally considered to be an undesirable impurity; the presence of intermetallic compounds containing iron is in general associated with a reduction in formability. Surprisingly, the present inventors found that a content beyond 0.05%, and better 0.10%, improves the ductility and formability, in particular by delaying rupture during deformation after contraction. Although they are not bound by this hypothesis, the present inventors think that this surprising effect could result in particular from the substantial reduction in the solubility of manganese in solid solution when this element is present and/or from the formation of a high density of intermetallic particles guaranteeing good "work-hardenability" during forming. In these proportions, iron may also help to control the grain size. Beyond a content of 0.25%, too many intermetallic particles are created, with a detrimental effect on ductility and corrosion resistance.

The most advantageous content range is 0.05 to 0.20%.

Mn: Its content is limited to 0.30%. Addition of manganese beyond 0.05% increases the mechanical properties by solid solution effect, but beyond 0.30% it would very greatly decrease sensitivity to the deformation rate and therefore ductility.

An advantageous range for manganese is 0.10 to 0.15%.

Cu: In alloys in the AA6000 family, copper is an effective hardening element, participating in hardening precipitation. At a minimum content of 0.05%, its presence makes it possible to obtain higher mechanical properties. In the alloy in question, copper beyond 0.30% has a negative influence on intergranular corrosion resistance. Preferably, the copper content is no more than 0.20%.

The most advantageous content range for copper is 0.08 to 0.15%.

V and Ti: Each of these elements, with Ti at a minimum content of 0.02%, may assist hardening by solid solution leading to the required level of mechanical properties and each of these elements has in addition a favourable effect on ductility in service and corrosion resistance. On the other hand, a maximum content of 0.10% for Ti as for V, and a sum of the contents of Ti and V Ti+V≤0.10%, are required in particular for avoiding conditions of formation of primary phases during vertical casting and improving the formability performance. The most advantageous content range is 0.03 to 0.10% for Ti. For V, in one embodiment, a V range of 0.03 to 0.8% is preferred; however, in another embodiment that is advantageous for recycling problems, the V content is maintained at no more than 0.03%.

The other elements are typically impurities, the proportion of which is maintained below 0.05%; the rest is aluminium. Among the impurities mention can be made for example of Cr, Ni, Zn, Zr and Pb. Preferably, some impurities are maintained at even lower proportions. Thus the Ni and Zr content is advantageously maintained below 0.03% and the Pb content is advantageously maintained below 0.02%.

The method for manufacturing sheets according to the invention typically comprises the casting of an ingot, the scalping of this ingot, followed by homogenisation thereof advantageously at a temperature-rise rate of at least 30° C./h to a temperature of 530° to 570° C., with holding time between 2 and 12 hours, preferentially between 4 and 6 hours, followed by cooling, either to ambient temperature, or to a temperature for start of hot rolling.

There follows, after reheating in the case of cooling to ambient temperature after homogenisation, hot rolling of the ingot in a strip with a thickness of between 3.5 and 10 mm, cold rolling to the final thickness, typically between 1 and 3.5 mm, solution-hardening of the rolled strip at a temperature beyond the solvus temperature of the alloy, while avoiding local fusion or incipient melting, that is to say between 540° and 570° C. for 10 seconds to 30 minutes, quenching at a rate of more than 30° C./s and better at least 100° C./s.

There optionally follows a pre-ageing, that is to say treatment at a temperature of between 50° and 100° C. for a period of at least 12 hours, typically obtained by coiling at a temperature of at least 60° C. followed by cooling in free air, and then natural ageing at ambient temperature for 72 hours to 6 months.

Thus the sheets according to the invention have very good suitability for stamping.

The sheets next undergo the operations of:

Forming, in particular by press stamping in order to obtain a three-dimensional part, Artificial ageing heat treatment at a temperature of approximately 205° C. with a holding time between 30 and 170 minutes, preferably between 60 and 120 minutes, or ageing at an equivalent time-temperature teq-Teq in accordance with the equation:

$$\int_0^t \exp\left(\frac{-Q}{RT}\right)dt = \int_0^{teq} \exp\left(\frac{-Q}{RTeq}\right)dt$$

where Q is equal to sensibly 82915 J, in which T is the instantaneous temperature expressed in Kelvin that changes with the time t and $T_{eq}$ is the reference temperature of 205° C. (478 K), and teq is the equivalent time.

Preferably the artificial ageing is carried out at a temperature of between 180° C. and 240° C. and preferably between 200° C. and 230° C. with a holding time between 30 and 120 minutes, the equivalent time for a reference temperature $T_{eq}$=205° C. being between 30 and 170 minutes and preferably between 60 and 120 minutes. The combination of the composition and the method according to the invention makes it possible to obtain a short ageing treatment, which is economically advantageous.

Painting and "bake hardening" at a temperature of 150° to 190° C. and preferably between 170° to 190° C. for 15 to 30 minutes.

The components thus manufactured have, in service, after forming, optimised on-part ageing, assembly and baking of the paints, high mechanical properties, very good crash resistance and good corrosion resistance.

Thus a stamped automobile bodywork or body structure, also referred to as "body in white", produced by a method of the invention is characterised in that its tensile yield strength in accordance with NF EN ISO 6892-1 is $Rp_{0.2}$≥270 MPa and preferably ≥275 MPa, and in that its "three-point bending angle" αnorm, determined in accordance with NF EN ISO 7838 and the procedures VDA 238-100 and VDA 239-200, is ≥100°, and preferably ≥105° with αnorm ≥−(4/3)*$Rp_{0.2}$+507.

Advantageously, a stamped automobile bodywork or body structure component, also referred to as "body in white", according to the invention is chosen from the group containing in particular door, bonnet, tailgate or roof linings or reinforcements, or the spars, bulkheads, load-bearing floors, tunnels and front, middle and rear pillars, as well as the impact absorbers or "crashboxes".

In its details, the invention will be better understood by means of the following examples, which do not however have any limitative character.

EXAMPLES

Preamble

Table 1 summarises the nominal chemical compositions (% by weight) of the alloys used during tests. The proportion of the other elements was <0.05.

TABLE 1

| Composition | Si | Fe | Cu | Mn | Mg | Ti | V | −2.67 × Si + 2.87 | Ti + V |
|---|---|---|---|---|---|---|---|---|---|
| 1 | 0.65 | 0.19 | 0.15 | 0.19 | 0.65 | 0.05 | 0.08 | 1.13 | 0.13 |
| 2 | 0.63 | 0.15 | 0.15 | 0.20 | 0.65 | 0.05 | 0.08 | 1.19 | 0.13 |
| 3 | 0.70 | 0.15 | 0.11 | 0.13 | 0.65 | 0.02 | — | 1.00 | 0.02 |
| 31 | 0.62 | 0.23 | 0.18 | 0.17 | 0.63 | 0.03 | — | 1.21 | 0.03 |
| 4 | 0.65 | 0.15 | 0.15 | 0.20 | 0.97 | 0.05 | 0.05 | 1.13 | 0.10 |

TABLE 1-continued

| Composition | Si | Fe | Cu | Mn | Mg | Ti | V | −2.67 × Si + 2.87 | Ti + V |
|---|---|---|---|---|---|---|---|---|---|
| 5 | 0.71 | 0.15 | 0.15 | 0.20 | 0.71 | 0.02 | 0.01 | 0.97 | 0.03 |
| 6 | 0.80 | 0.14 | 0.14 | 0.20 | 0.54 | 0.02 | — | 0.73 | 0.02 |
| 7 | 0.90 | 0.24 | 0.09 | 0.17 | 0.41 | 0.02 | — | 0.47 | 0.02 |
| 8 | 0.56 | 0.24 | 0.09 | 0.13 | 0.53 | 0.02 | — | 1.37 | 0.02 |
| 9 | 0.67 | 0.30 | 0.09 | 0.15 | 0.64 | 0.02 | — | 1.08 | 0.02 |
| 10 | 1.00 | 0.24 | 0.17 | 0.17 | 0.60 | 0.02 | — | 0.20 | 0.02 |

The rolling ingots of these various alloys were obtained by vertical semi-continuous casting. After scalping, these various ingots underwent homogenisation heat treatment and/or reheating, the temperatures of which are given in Table 2.

The ingots of composition 1, 2, 7 and 8 underwent homogenisation treatment at 530° C. consisting of a temperature rise at a rate of 30° C./hour up to 530° C. and holding time around 3 hours at this temperature. This homogenisation step is directly followed by a hot rolling step.

The ingots of composition 3, 31 and 9 underwent homogenisation treatment at 540° C. consisting of a temperature rise at a rate of 30° C./hour up to 540° C., and holding time around 5 hours at this temperature directly followed by the hot rolling.

The ingots of composition 4, 5 and 6 underwent homogenisation consisting of a rise to 570° C. with minimum holding time of 2 hours at this temperature, directly followed by hot rolling.

The ingot of composition 10 underwent homogenisation treatment at 550° C. consisting of a temperature rise at a rate of 30° C./hour up to 550° C., and holding time around 4 hours at this temperature. This homogenisation step is directly followed by a hot rolling step.

The following hot rolling step takes place on a reversible rolling mill followed, according to circumstances, by a four-cage hot tandem rolling mill to a thickness of between 3.5 and 10 mm. The output hot-rolling thicknesses of these cases tested are given in table 2.

It is followed by a cold rolling step that makes it possible to obtain sheets with thicknesses of between 2.0 and 2.5 mm. The cold-rolling output thicknesses of the cases tested are given in table 2 below.

The rolling steps are followed by a solution heat treatment step and quenching. The solution heat treatment takes place at a temperature beyond the solvus temperature of the alloy, while avoiding incipient melting. The solutionized sheet is next quenched at a minimum rate of 30° C./second. For tests 18 to 21, a minimum rate of 100° C./second was used.

For all cases, except for cases 2, 4, 5 and 6, this step is carried out in a continuous furnace by increasing the temperature of the metal to the solutionizing temperature in less than one minute approximately, directly followed by quenching.

For cases 2, 4, 5 and 6, the solution heat treatment takes place in a convection furnace with introduction into a hot furnace, achieving the solutionizing temperature in less than 20 minutes and holding at this temperature for 30 minutes.

This solution heat treatment step is followed by quenching by immersion in water at 85° C.

The quenching is followed by pre-ageing heat treatment, intended to improve the hardening performance during the baking of the paints.

For all the cases tested, except cases 2, 4, 5 and 6, this step is carried out by coiling at a temperature of at least 60° C. followed by cooling in free air. For cases 2, 4, 5 and 6, the pre-ageing is obtained by immersion and holding the sheets in water at 85° C. for 8 hours. In all cases, natural ageing at ambient temperature of at least 72 hours is next carried out.

TABLE 2

| Composition | Homogenisation | Thickness HR output | Thickness CR output |
|---|---|---|---|
| 1 | 530° C. | 10 mm | 2.5 mm |
| 2 | 530° C. | 10 mm | 2.5 mm |
| 3 | 540° C. | 6.3 mm | 2.0 mm |
| 31 | 540° C. | 4.3 mm | 2.5 mm |
| 4 | 570° C. | 10 mm | 2.5 mm |
| 5 | 570° C. | 10 mm | 2.5 mm |
| 6 | 570° C. | 10 mm | 2.5 mm |
| 7 | 530° C. | 6.3 mm | 2.0 mm |
| 8 | 530° C. | 4.3 mm | 2.0 mm |
| 9 | 540° C. | 10 mm | 2.5 mm |
| 10 | 550° C. | 5.0 mm | 2.3 mm |

The steps of solution heat treatment, quenching, pre-ageing and natural ageing at ambient temperature for a minimum time of 72 hours are followed by heat treatments, referred to as ageing, as described in table 3. The ageings C, D, E, H and I have conditions according to the invention.

After ageing, all these tests undergo heat treatment simulating the baking of the paints in a convection furnace with introduction into a hot furnace and holding time for 20 minutes at 185° C.

TABLE 3

| Test number | Composition | Ageing | Time [min] | Temperature [° C.] | Equivalent time at 205° C. |
|---|---|---|---|---|---|
| 1 | 1 | E | 120 | 205 | 120 |
| 2 | 1 | B | 480 | 205 | 480 |
| 3 | 1 | F | 960 | 205 | 960 |
| 4 | 2 | A | 240 | 205 | 240 |
| 5 | 3 | A | 240 | 205 | 240 |
| 6 | 4 | A | 240 | 205 | 240 |
| 7 | 5 | A | 240 | 205 | 240 |
| 8 | 6 | A | 240 | 205 | 240 |
| 9 | 7 | D | 60 | 205 | 60 |
| 10 | 7 | B | 480 | 205 | 480 |
| 11 | 8 | E | 120 | 205 | 120 |
| 12 | 8 | A | 240 | 205 | 240 |
| 13 | 9 | E | 120 | 205 | 120 |
| 14 | 9 | F | 960 | 205 | 960 |
| 14 | 10 | C | 30 | 205 | 30 |
| 16 | 10 | G | 1920 | 205 | 1920 |
| 17 | 31 | A | 240 | 205 | 240 |
| 18 | 31 | C | 30 | 205 | 30 |
| 19 | 31 | D | 60 | 205 | 60 |
| 20 | 31 | H | 60 | 215 | 92 |
| 21 | 31 | I | 60 | 225 | 138 |

Tensile Test

Tensile tests at ambient temperature were carried out in accordance with NF EN ISO 6892-1 with non-proportional test pieces, with a geometry widely used for sheets, and corresponding to the type of test piece 2 in table B.1 of Appendix B of said standard. These test pieces in particular have a width of 20 mm and a calibrated length of 120 mm.

The results of these tensile tests in terms of conventional tensile yield strength at 0.2%, $Rp_{0.2}$, and measured on the sheets as manufactured in accordance with the conditions described in the previous paragraph, are given in table 4 below.

The protocols recommend, for the parts formed in the metallurgical temper T4 and then undergoing the paint baking treatment, carrying out, between natural ageing and baking of the paints, a predeformation under controlled traction of 2%, for simulating forming by stamping.

It is therefore possible to consider that the tensile characteristics of the sheet in the final metallurgical state are not significantly different from those of the final stamped component.

Evaluation of Crash Resistance

Crash resistance can be estimated by a "three-point bending test" in accordance with NF EN ISO 7438 and the procedures VDA 238-100 and VDA 239-200. The bending device is as presented in FIG. 1.

The "three-point bending" strictly speaking is carried out using a punch B with a radius r=0.4 mm, the sheet being supported by two rollers R, the bending axis being parallel to the rolling direction. The rollers have a diameter of 30 mm and the distance between the axes of the rollers is equal to 30+2t mm, t being the thickness of the tested sheet T.

At the start of the test the punch is put in contact with the sheet with a pre-force of 30 newtons. Once the contact is established, the movement of the punch is indexed at zero. The test then consists of moving the punch so as to carry out the "three-point bending" of a sheet.

The test stops when a microcracking of the sheet leads to a reduction in force on the punch of at least 30 newtons, or when the punch has moved by 14.2 mm, which corresponds to the maximum permitted travel.

Figure 2:
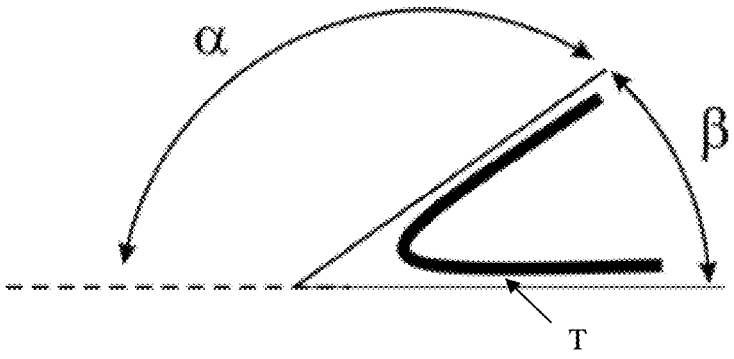
FIG. 2 depicts the sheet T after the "three-point bending" test with the internal angle β and the external angle, the measured result of the test: α.

At the end of the test, the sample of sheet is therefore folded as illustrated in FIG. 2. Ductility in service is then assessed by measuring the bending angle α. The higher the angle α, the better is suitability for crashing or bending of the sheet. In order to be able to compare the performances of the cases tested, all the angles measured for various thicknesses of sheet are adjusted to the value αnorm, in accordance with the following table as described in the standard VDA 239-200:

$$\alpha_{norm} = \alpha_m \frac{\sqrt{t_m}}{\sqrt{t_{ref}}}$$

with:

$\alpha_{norm}$: standardised angle, $\alpha_m$: measured angle, $t_{ref}$: reference thickness, $t_m$: measured thickness.

The results of these bending tests on the sheets as manufactured in accordance with the conditions described in the paragraph "Preamble" are given in table 4 below, in the same order as in table 3. The reference thickness $t_{ref}$ was 2.0 mm.

The protocols recommend, for the parts formed in the metallurgical temper T4 and then undergoing the paint baking treatment, carrying out, between natural ageing and the baking of the paints, a predeformation under controlled traction of 10%, in order to simulate forming by stamping. In the case of the ageing treatment after natural ageing according to the invention, this predeformation has no very significant effect on the properties of the final component.

It can therefore be considered that the behaviour under bending of the sheets in the final metallurgical temper is not significantly different from that of the finished stamped component.

TABLE 4

| Test number | Composition | Rp0.2 [MPa] | αnorm [°] |
|---|---|---|---|
| 1 | 1 | 285 | 72 |
| 2 | 1 | 263 | 98 |
| 3 | 1 | 235 | 113 |
| 4 | 2 | 287 | 109 |
| 5 | 3 | 265 | 93 |
| 6 | 4 | 312 | 98 |
| 7 | 5 | 295 | 103 |
| 8 | 6 | 275 | 99 |
| 9 | 7 | 249 | 70 |
| 10 | 7 | 218 | 93 |
| 11 | 8 | 249 | 91 |
| 12 | 8 | 238 | 99 |
| 13 | 9 | 268 | 61 |
| 14 | 9 | 209 | 103 |
| 14 | 10 | 290 | 75 |
| 16 | 10 | 239 | 91 |
| 17 | 31 | 261 | 94 |
| 18 | 31 | 295 | 97 |
| 19 | 31 | 305 | 110 |
| 20 | 31 | 295 | 120 |
| 21 | 31 | 275 | 160 |

Figure 3:
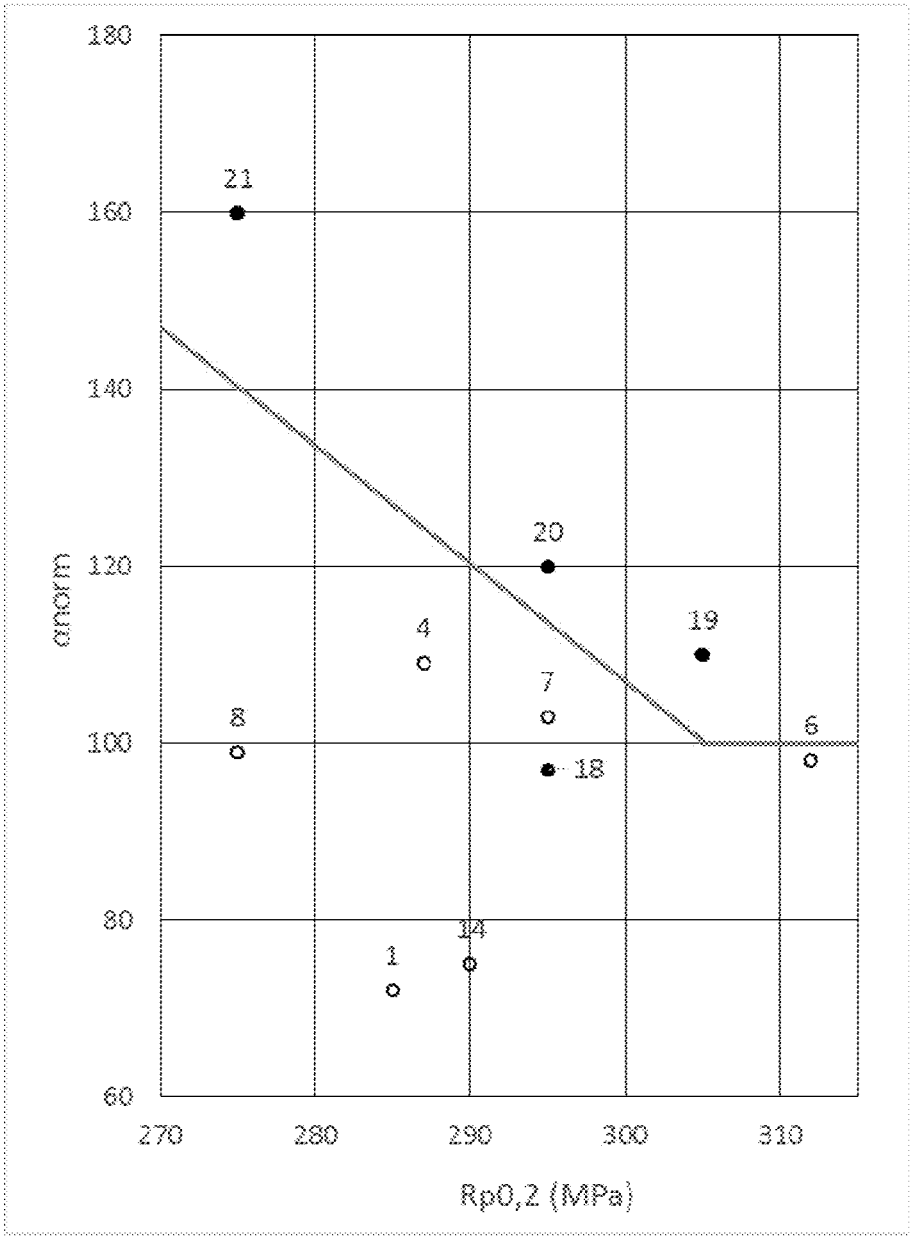
FIG. 3 depicts a compromise between the tensile yield strength and the bending angle for a selection of tests.

By combining the preferred ageing and the composition according to the invention, in accordance with tests 19, 20 and 21, a remarkable compromise in property is achieved, that is to say a tensile yield strength $Rp_{0.2} \geq 270$ MPa and preferably ≥275 MPa, as well as a bending angle αnorm without cracking ≥100° and preferably ≥105° and αnorm $\geq -(4/3)*Rp_{0.2}+507$, which is illustrated by FIG. 3. Thus examples 4 and 7 make it possible to obtain a tensile yield strength $Rp_{0.2} \geq 270$ MPa as well as a bending angle αnorm without cracking ≥100° but do not make it possible to obtain and that a bending angle αnorm without cracking αnorm $\geq -(4/3)*Rp_{0.2}+507$.

The invention claimed is:

1. A method for manufacturing a stamped component, for automobile bodywork or body structure, comprising a "body in white", from aluminium alloy, intended to absorb energy irreversibly during an impact, comprising:

manufacturing a sheet or strip with a thickness of between 1 and 3.5 mm from an alloy with the composition (% by weight):

Si: 0.60-0.85; Fe: 0.05-0.25; Cu: 0.05-0.30; Mn: 0.05-0.30; Mg: 0.50-1.00 and Mg <−2.67×Si+2.87; Ti: 0.02-0.10; V: 0.00-0.10 with Ti+V<0.10 other elements <0.05 each and <0.15 in total, the remainder aluminium, solution heat treating, quenching and optional pre-ageing at a temperature generally between 50° and 100° C. for a period of at least 12 hours, natural ageing at ambient temperature, forming in order to obtain a three-dimensional part, artificial ageing the three-dimensional part at a temperature of 205° C. with a holding time between 30 and 170 minutes, or artificial ageing the three-dimensional part with an equivalent holding time $t_{eq}$ of between 30 and 170 minutes at a temperature $T_{eq}$ of 205° C. in accordance with the equation:

$$t_{eq} = \exp\left(\frac{Q}{R * T_{eq}}\right) * \int_0^t \exp\left(-\frac{Q}{R * T} dt\right)$$

where Q is equal to sensibly 82915 J, in which T is the instantaneous temperature expressed in Kelvin that changes with time t and $T_{eq}$ is the reference temperature of 205° C. (478 K), and $t_{eq}$ is the equivalent holding time, painting and "bake hardening" at a temperature of 150° to 190° C. for 15 to 30 minutes.

2. The method according to claim 1, wherein the time for maintaining the artificial ageing at 205° C. is between 60 and 120 minutes or at the equivalent holding time $t_{eq}$ of between 60 and 120 minutes at a temperature $T_{eq}$ of 205° C.

3. The method according to claim 1, wherein the Si content in the sheet or strip is between 0.60 and 0.75.

4. The method according to claim 1, wherein the Fe content in the sheet or strip is between 0.05 and 0.20.

5. The method according to claim 1, wherein the Cu content of the sheet or strip is no more than 0.20.

6. The method according to claim 1, wherein the Mn content of the sheet or strip is between 0.10 and 0.15.

7. The method according to claim 1, wherein the Mg content of the sheet or strip is between 0.60 and 0.70.

8. The method according to claim 1, wherein the Ti content of the sheet or strip is between 0.03 and 0.10.

9. The method according to claim 1, wherein the V content of the sheet or strip is between 0.03 and 0.08.

10. The method according to claim 1, wherein the manufacturing of the sheet or strip before stamping comprises:

vertical semi-continuous casting of an ingot and scalping thereof, homogenisation of an ingot at a temperature of 530° to 570° C. with holding of between 2 and 12 hours, hot rolling of the ingot in a strip with a thickness of between 3.5 and 10 mm, cold rolling to a final thickness.

11. The method according to claim 1, wherein forming is by press stamping and wherein after the painting and "bake hardening" at a temperature of 150° to 190° C. for 15 to 30 minutes, the stamped component has a tensile yield strength, determined in accordance with NF EN ISO 6892-1, of $Rp_{0.2} \geq 270$ MPa and a "three-point bending angle" αnorm, determined in accordance with NF EN ISO 7438 and the procedures VDA 238-100 and VDA 239-200, of ≥100° with $\alpha norm \geq -(4/3) * Rp_{0.2} + 507$.

12. The method according to claim 11, wherein the component has a tensile yield strength of Rp0.2≥275 MPa and a "three-point bending angle" αnorm of ≥105°.

13. The method according to claim 1, wherein:

pre-ageing occurs and is obtained by coiling the sheet or strip at a temperature of at least 60° C. followed by cooling in open air, natural ageing at ambient temperature occurs between 72 hours and 6 months, forming is by press stamping, and painting and "bake hardening" is at a temperature of 170° to 190° C. for 15 to 30 minutes.

14. The method according to claim 1, wherein the Cu content of the sheet or strip is between 0.08 and 0.15.

15. The method according to claim 10, wherein the homogenisation of the ingot is at a temperature of 530° to 570° C. with holding of between 4 and 6 hours.

* * * * *